US005813727A

United States Patent [19]

Sugawa et al.

[11] Patent Number: 5,813,727

[45] Date of Patent: Sep. 29, 1998

[54] MASSAGING CHAIR

[75] Inventors: Akihide Sugawa; Hikoyoshi Hara; Masatoshi Dairin; Hironobu Sakaue; Fumihiro Nishio, all of Hikone, Japan

[73] Assignee: Matsushita Electric Works, Ltd., Kadoma, Japan

[21] Appl. No.: 706,359

[22] Filed: Aug. 30, 1996

Related U.S. Application Data

[63] Continuation of Ser. No. 426,079, Apr. 21, 1995, abandoned.

[30] Foreign Application Priority Data

Jun. 27, 1994 [JP] Japan ..... 6-145174

[51] Int. Cl.[6] ..... A47C 7/54

[52] U.S. Cl. ..... 297/411.42; 297/217.3; 297/227; 297/451.3; 297/452.18; 601/115; 601/98

[58] Field of Search ..... 297/217.3, 362.13, 297/361.1, 411.42, 411.23, 90, 227, 411.46, 451.3, 451.7, 452.18; 601/98, 99, 115, 116

[56] References Cited

U.S. PATENT DOCUMENTS

| | | | |
|---|---|---|---|
| D. 148,666 | 2/1948 | Vincent | 297/411.42 X |
| 2,281,209 | 4/1942 | Smith | 297/411.42 X |
| 2,661,052 | 12/1953 | Bushong | 297/411.46 X |
| 2,690,212 | 9/1954 | Jakeway | 297/227 |
| 2,914,119 | 11/1959 | Keefe, Jr. | 297/411.46 X |
| 3,027,196 | 3/1962 | Hamilton | 297/411.46 |
| 3,271,073 | 9/1966 | Van Buren, Jr. | 297/227 X |
| 3,594,041 | 7/1971 | Rye | 297/451.3 |
| 4,422,448 | 12/1983 | Sugai et al. | 601/99 |
| 4,574,786 | 3/1986 | Hashimoto et al. | 601/99 |
| 4,576,149 | 3/1986 | Otuka et al. | 601/99 |
| 4,597,606 | 7/1986 | Magee | 297/411.46 |
| 4,629,300 | 12/1986 | Akimoto | 354/76 |
| 4,790,596 | 12/1988 | Shifferaw | 297/451.7 |
| 5,456,657 | 10/1995 | Cheng | 601/99 X |
| 5,498,055 | 3/1996 | Goldman | 297/362.13 X |

FOREIGN PATENT DOCUMENTS

| | | | |
|---|---|---|---|
| 711409 | 6/1931 | France | 297/90 |
| 638984 | 11/1936 | Germany | 297/451.3 |
| 4131632 | 4/1992 | Germany | 601/99 |
| 6125957 | 5/1994 | Japan | 601/98 |

*Primary Examiner*—Peter M. Cuomo
*Assistant Examiner*—David E. Allred
*Attorney, Agent, or Firm*—Armstrong, Westerman, Hattori, McLeland & Naughton

[57] ABSTRACT

A massaging chair is capable of assuring comfortable use, both in the sitting and lying positions. The massaging chair comprises a seat, a reclining backrest pivotally connected about a pivot axis to the seat so as to be movable between an upright position and a horizontal position with respect to the seat, and a massager is disposed on the side of the reclining backrest to give a massage to a back of a user resting on said seat. A pair of armrests are disposed on the opposite sides of said seat. The armrests are designed to extend arcuately substantially about the pivot axis of the backrest. With this arrangement, the user's arms on the armrests can be kept at a fixed comfortable angular relationship with respect to his or her body, irrespective of the varying angles of the reclining backrest on which the user rests with varying posture. Thus, the massaging chair assures enjoyment to the user of a massage in a comfortable posture irrespective of the angular position of the reclining backrest relative to the seat.

5 Claims, 5 Drawing Sheets

62
61
52
38
71
70
64
63
34
33
32
31
40
41
16
63
65
64
18
51
14
30
83
11
17
82
81
85
12
50
14
13
16
34
36
X
37
31
38
39
32
30
20
21
21
22
23

MASSAGING CHAIR

This application is a continuation of application Ser. No. 08/426,079 filed Apr. 21, 1995, now abandoned.

BACKGROUND OF THE INVENTION

1. Field of the Invention

The present invention is directed to a massaging chair, and more particularly, a massaging chair with a reclining backrest.

2. Description of the Prior Art

A massaging chair with a reclining backrest is known in the art as, for example, disclosed in U.S. Pat. Nos. 4,422,448 and 4,574,786. In such prior massaging chair, a pair of armrests is provided only at a location suited for supporting the arms of the user resting on the chair with the reclining backrest in an upright position, and is not suited for supporting the arms when the user rests flat on the chair with the reclining backrest extended in the horizontal position. Thus, the user is made rather uncomfortable when resting flat on the extended backrest. In addition, since it is difficult for the user lying on the flattened backrest to access the armrests, the user is compelled to exert abdominal muscles for raising his or her body from the flattened backrest, which causes much fatigue and reduce the utility of the massaging chair.

SUMMARY OF THE INVENTION

The above insufficiency has been eliminated in the present invention which provides a massaging chair capable of assuring a comfortable use both in the sitting and reclining positions. The massaging chair in accordance with the present invention comprises a seat, a reclining backrest pivotally connected about a pivot axis to the seat so as to be movable between an upright position and a horizontal position with respect to the seat, and a massager is disposed on the side of the reclining backrest to give a massage to a back of a user resting on said seat. A pair of armrests are disposed on the opposite sides of said seat. The armrest is designed to extend arcuately substantially about the pivot axis. With this arrangement, the user can have his or her arms on the armrests kept at a fixed, comfortable angular relationship with respect to his or her body, irrespective of the various angles of the reclining backrest on which the user rests with varying posture.

Accordingly, it is a primary object of the present invention to provide a massaging chair which is capable of assuring the user enjoyment of a massage in a comfortable posture irrespective of the angular position of the reclining backrest relative to the seat.

The armrest extends rearwardly beyond the front surface of the backrest when in the horizontal position or flattened position. Therefore, the user, even when lying on the flattened backrest, can access the armrest with ease so that the user can raise his or her body readily without relying much on the abdominal muscles, which is therefore another object of the present invention.

The massaging chair includes a pair of legs supporting the seat on a floor. Each leg has an upper portion curved arcuately in conformity with the armrest and is provided at the upper portion with a fitting which has a catch notch elongated along the upper portion. The armrest is slidably fitted to the upper portion of the leg by engagement of a stud projecting from the armrest into the notch. Thus, the armrest can be readily attached and detached to and from the leg for easy replacement when the armrest is worn out.

The armrest is preferably made of a material having a high coefficient of friction for avoiding slipping of the arm on the armrest and, consequently, for facilitating to raising of the user's body.

The massaging chair includes a control unit for controlling the massager. The control unit is provided with a magnet which is magnetically attached to a desired portion of the leg made of a magnetic material such that the user can locate the control unit at a suitable position which may be different when the user is in a sitting position on the chair from when the user is in a reclined position lying on the backrest.

The massaging chair includes a lock mechanism which locks the reclining backrest at a desired angle relative to the seat and includes a release handle which releases the lock mechanism to allow the backrest to be freely movable about the pivot axis. The release handle is positioned adjacent to the pivot axis so as to be accessible by the user equally in the sitting position and in the reclined position. Thus, the user in any posture can readily operate the release handle to change the position of the backrest.

These and still other objects and advantageous features of the present invention will become more apparent from the following description of the embodiments when taken in conjunction with the attached drawings.

DETAILED DESCRIPTION OF THE EMBODIMENTS

Figure 8:
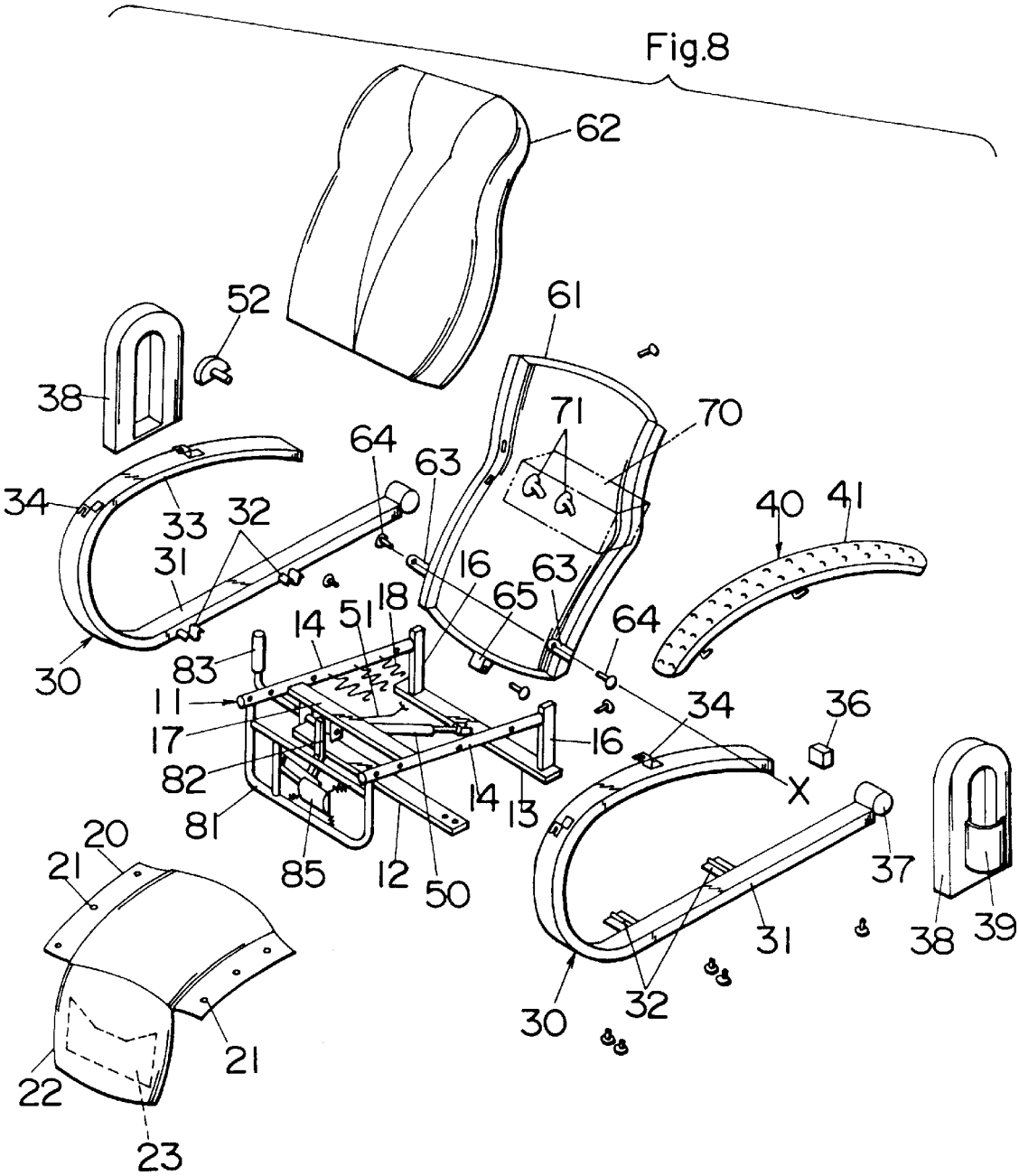
FIG. 8 is an exploded perspective view of the massaging chair.

Referring to FIGS. 1 to 5, there is shown a massaging chair in accordance with a preferred embodiment of the present invention. The massaging chair comprises a seat 10, a reclining backrest 60 mounting the massager 70, and a retractable ottoman 80 incorporating a vibrator 85. As shown in FIG. 8, the seat 10 includes a seat frame 11 which carries a seat cushion 20 and which comprises a pair of front and rear foot plates 12 and 13, a pair of side stretchers 14, and a pair of opposed legs 30 of a generally U-shaped configuration. The side stretchers 14 are connected at the rear ends to the upper ends of prop 16 upstanding from the side ends of the rear foot plate 13. A front stretcher 17 extends between the front ends of the side stretchers 14. The legs 30 each have a lower straight member 31 with inward stubs 32 which are inserted into the side ends of the front and rear foot plates 12 and 13 for connection of the legs 30 to the seat frame 11. Bridging between the side stretchers 14 are springs 18 which support the seat cushion 20 attached to the seat frame 11 by engagement of hooks 21 on the lateral sides of the cushion 20 with corresponding members at the side stretchers 14.

The ottoman 80 comprises a front frame 81 of which upper end is hinged to the front end of the seat frame 11. The front frame 81 carries the vibrator 85 and is connected through a link 82 to a lever 83 so as to be movable by manipulation of the lever 83 between an extended position, as indicated by dotted line in FIG. 4, and a retracted position, as indicated by solid line in FIGS. 4 and 6.

The backrest 60 comprises a back frame 61 carrying a back covering 62 and the massager 70. The back frame 61 is provided with hinge plates 63 which project from the respective lateral sides at the lower end thereof and are pivotally connected by means of pivot pins 64 to the upper end of the prop 16, at the rear end of the seat frame 11 so that the backrest 60 is pivotable about the pivot pins 64 relative to the seat 10 between an erect position of FIG. 6 and a horizontal position of FIG. 7. Projecting from the lower center of the back frame 61 is a bracket 65 which is connected to the front stretcher 17 of the seat frame 11 by means of a telescopic gas cylinder 50. The gas cylinder 50 is pivotally connected at its opposite ends to the front stretcher 17 and the bracket 65 of the back frame 61 in order to keep the backrest 60 at any angular position relative to the seat 10. The gas cylinder 50 includes a spring which normally urges the backrest 60 into the erect position. This spring action is normally blocked by a lock mechanism incorporated in the gas cylinder 50 so as to maintain the backrest at a position as it is. A release mechanism is also incorporated in the gas cylinder 50 to release the lock mechanism for moving the backrest 60 to the erect position. The release mechanism is connected through an external wire 51 to a handle 52 and is actuated by the handle 52 for moving the backrest 60 to the erect position.

The massager 70 is movably supported to the back frame 61 to move along the length of the backrest 60 by an incorporated motor (not shown) and is provided with a pair of projecting applicators 71 for pressing engagement with the back of a user on the chair. The applicators 71 are driven by the same motor to move them for applying kneading and rolling massage actions over an extended portion of the user's back, either alone or in combination with the lengthwise movement of the massager 70. A remote controller 90 extends from the massager 70 to be manipulated by the user. The remote controller 90 has a magnet (not shown) by which the controller can be detachably held at any desired position on the leg 30 where it is convenient for the user to manipulate. A pedestal 38 is fixed to the exterior of each leg 30 adjacent the pivot axis about which the backrest 60 moves relative the seat 10. One of the pedestals 38 is provided with a holder 39 for storing the remote controller 90, while the other pedestal 38 carries the handle 52 for raising the backrest 60 by releasing the lock mechanism of the gas cylinder 50, as described in the above.

Figure 1:
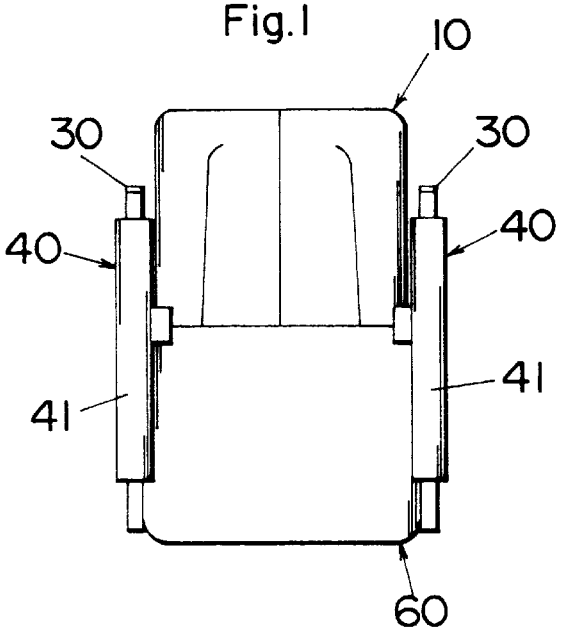
FIG. 1 is a top view of a massaging chair in accordance with a preferred embodiment of the present invention.
Figure 2:
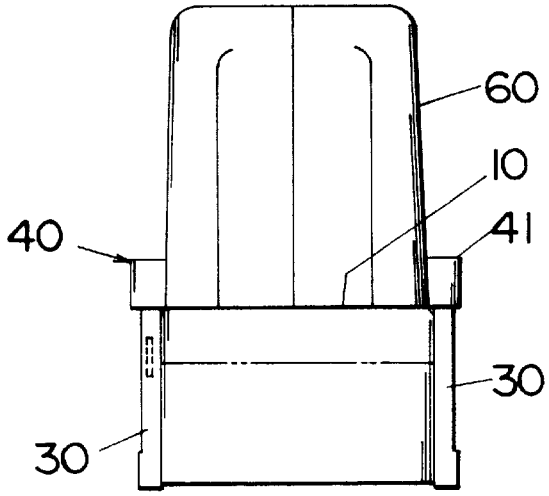
FIG. 2 is a front view of the massaging chair.
Figure 3:
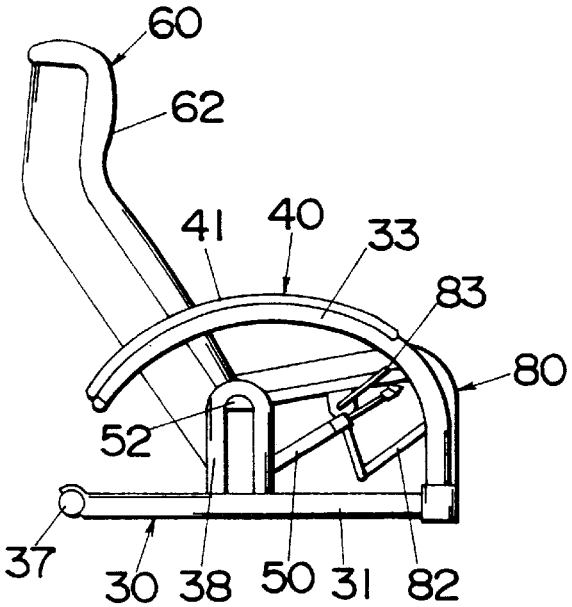
FIG. 3 is a right side view of the massaging chair.
Figure 4:
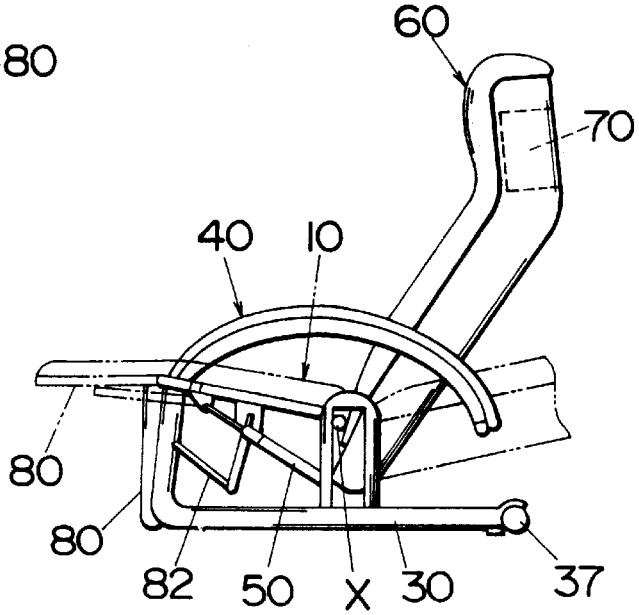
FIG. 4 is a left side view of the massaging chair.
Figure 5:
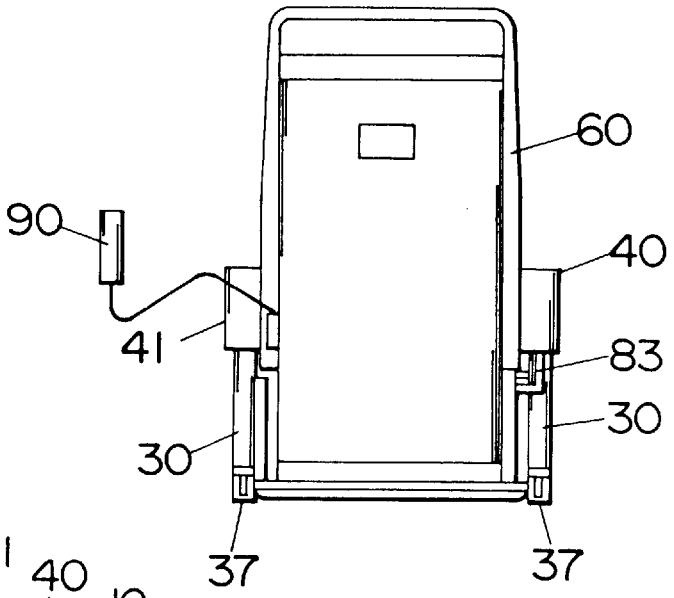
FIG. 5 is a rear view of the massaging chair.
Figure 6:
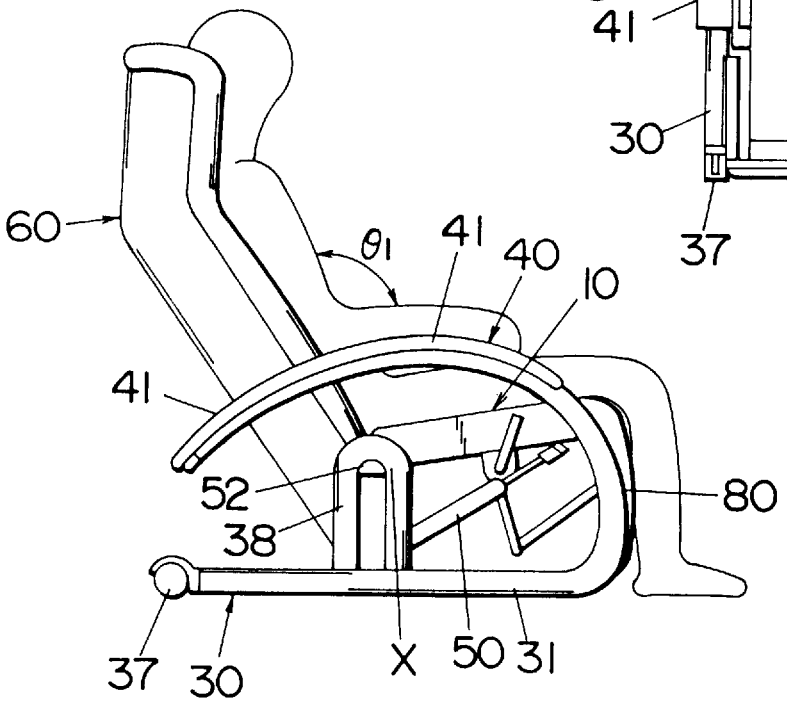
FIG. 6 is a side view of the massaging chair with a reclining backrest shown in its erect position.
Figure 7:
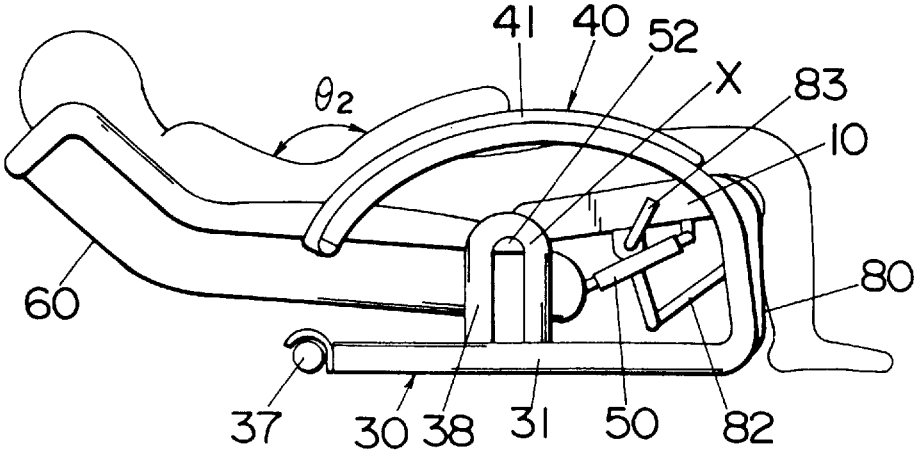
FIG. 7 is a side view of the massaging chair with the reclining backrest shown in its horizontal position.

The generally U-shaped leg 30 is made of a magnetic material, for example, iron pipe of ellipsoidal cross section and has an arcuately curved section 33 which is centered approximately on a horizontal axis X of the pivot pin 64. An arm cushion 41 is fitted over the curved section 33 to define therewith an armrest 40. Since the armrest 40 is arcuately curved substantially about the pivot axis for the backrest, an angle $\theta_1$ at which the user's arm rests on the armrest with the backrest 60 in the erected position of FIG. 6 is kept approximately equal to an angle $\theta_2$ of the same with the backrest 60 in the horizontal position of FIG. 7, and equal to an angle of the intermediate position. Consequently, the user can keep substantially the same attitude relative to the armrests 40 irrespective of the changing positions of the backrest, thereby enjoying effective and consistent massage actions. This is particularly advantageous when the user changes the position while the massager 70 is operating. The rear end of the armrest 40 extends past the front surface of the backrest 60 when the backrest is in the horizontal position of FIG. 7 so that the user, lying flat on the backrest, can utilize and grip the armrests 40 to raise his or her body easily. The handle 52 in the pedestal 38 is located on the pivot axis so that the user, at any position, can equally access the handle 52 for facilitating raising of the backrest from any position.

Figure 11:
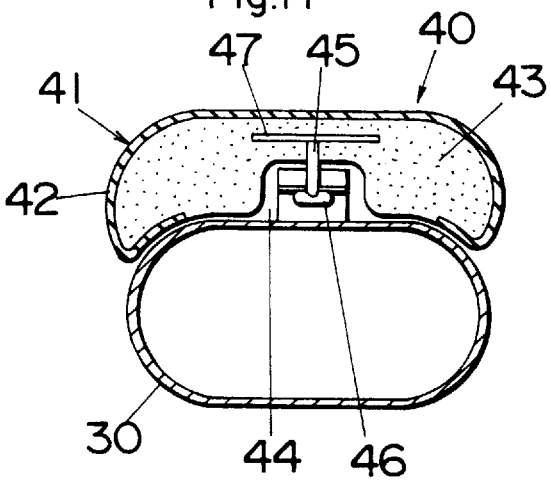
FIG. 11 is a transverse cross-sectional view of a connection between an armrest and the leg.
Figure 12:
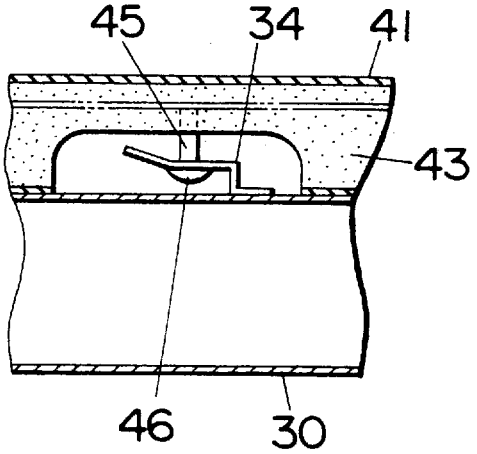
FIG. 12 is cross-sectional view of a connection between an armrest and the leg taken in the longitudinal direction.

The arm cushion 41 comprises an outer cover 42 covering an elastic filler 43 made of urethane resin. The outer cover 42 is made of a rubber, or the like, having a high coefficient of friction and is knurled to permit a firm gripping with which the user can securely hold the armrests when raising the body, or for pressing the back against the massager, and for pressing the feet against the ottoman 80 for facilitating these operations. As shown in FIGS. 11 and 12, the arm cushion 41 is provided in its lower surface with a recess 44 elongated in a lengthwise direction. A stud 45 with an enlarged head 46 is anchored to a plate 47 in the arm cushion 41 and projects into the recess 44 for engagement with a corresponding fitting 34 secured on the curved section 33 of the leg 30. The fitting 34 is bifurcated to define a notch 35 elongated in the lengthwise direction of the leg 30. With the use of the fitting 34, the arm cushion 41 is attached to the leg 30 simply by placing the arm cushion 41 on the leg 30 with the fitting 34 being received within the concave 44 followed by sliding the arm cushion 41 along the length of the leg 30, whereby the stud 45 is guided into the notch 35 for engagement therewith at the head 46. In this manner, the arm cushion 41 can be easily attached and detached to and from the leg 30 for easy replacement or cleaning purposes. Additionally, a screw may be utilized to secure the thus attached arm cushion 41 to the leg 30. The leg 30 is fitted at its end with an end cap 36 at its one end and with a caster 37 at the other end.

Figure 9:
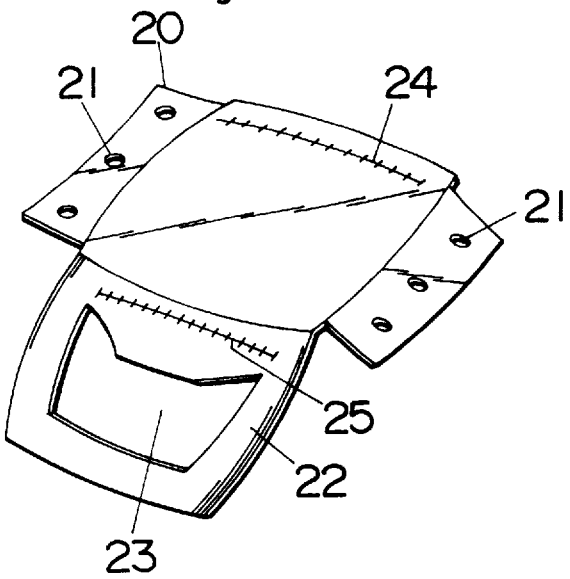
FIG. 9 is a perspective view of a seat covering.
Figure 10:
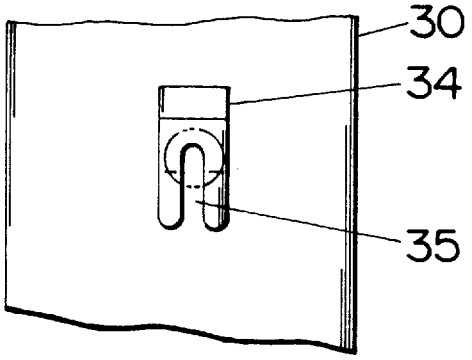
FIG. 10 is a top view of a portion of a leg of the massaging chair.

As shown in FIG. 9, the seat cushion 20 integrally includes an apron 22 with a pocket 23 into which the front frame 81 and the vibrator 85 of the ottoman 80 are received together. Zippers 24 and 25 are provided for the seat cushion 20 for enabling removal of a cushioning material, such as a urethane mat, or the like, out of the seat cushion 20 for cleaning and replacement.

Figure 13:
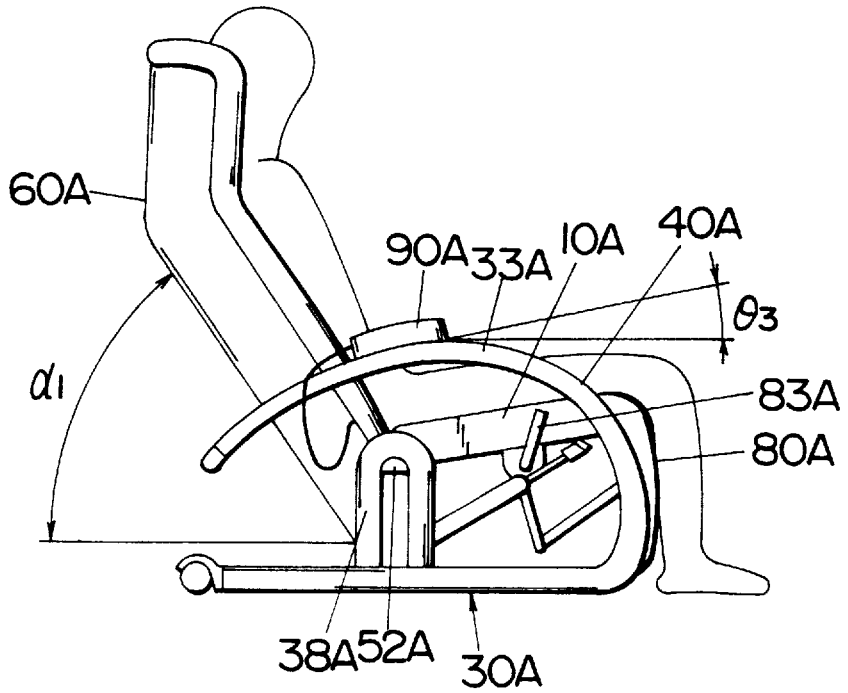
FIG. 13 is a side view of the massaging chair with a reclining backrest shown in its erect position, in accordance with a second embodiment of the present invention.
Figure 14:
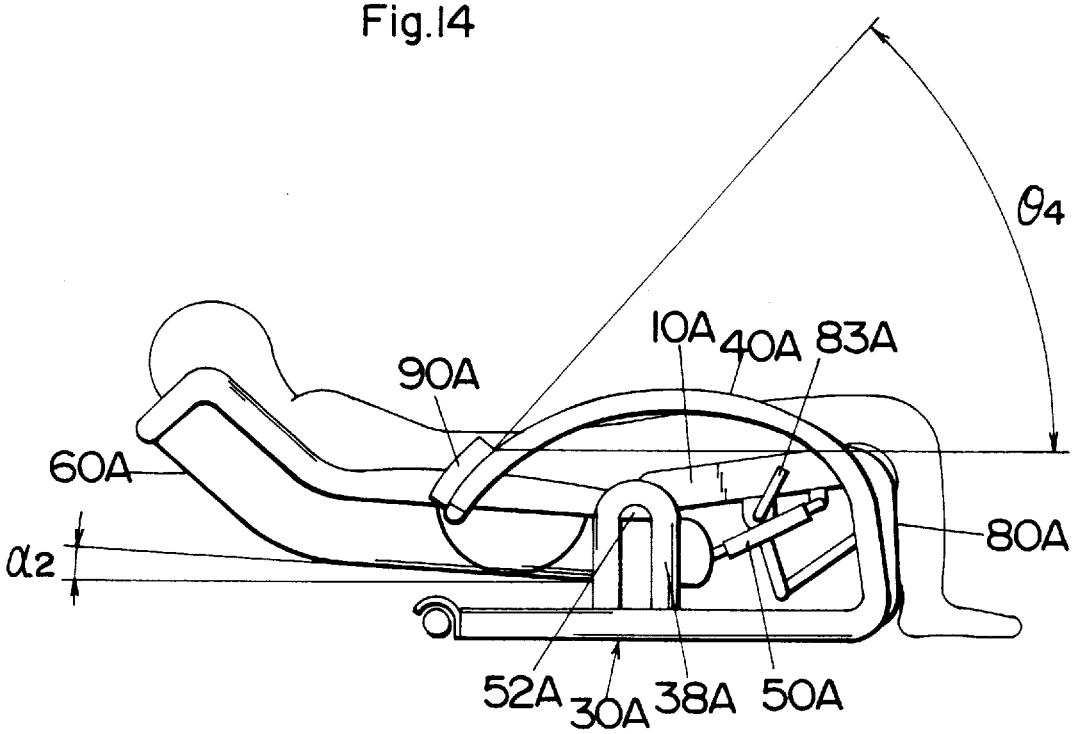
FIG. 14 is a side view of the massaging chair of the second embodiment with the reclining backrest shown in its horizontal position.

FIGS. 13 and 14 illustrate a massaging chair in accordance with another embodiment of the present invention which is identical in structure to the above described embodiment except that the leg 30A itself defines the armrest 40A at its upper curved section 33A. Like parts are designated by like numerals with a suffix letter of A, and no duplicate description is made herein for the sake of simplicity. The remote controller 90A with the magnet is detachably mounted on the armrest 40A at any portion along the length thereof. Accordingly, the user can have the same viewing angle to the remote controller 90A irrespective of varying angular position of the backrest 60A. For instance, as shown in FIG. 13, when the user rests on the chair with the backrest 60A being disposed at an angle $\alpha_1$ relative to the horizontal and the remote controller 90A is inclined at an angle $\theta_3$ relative to the horizontal, the viewing angle $V_1$ of the remote controller will be $V_1 \approx \alpha_1 + \theta_3$. And, as shown in FIG. 14, when the user rests flat on the chair with the backrest 60A being disposed at an angle $\alpha_2$ relative to the horizontal and the remote controller 90A is inclined at an angle $\theta_4$ relative to the horizontal, the viewing angle $V_2$ of the remote controller will be $V_2 \approx \alpha_2 + \theta_4$. Therefore, the same view angle is assured by suitably changing the position of the remote controller 90A along the curvature of the armrest 40A in such a manner as to satisfy the relationship that $\alpha_1 + \theta_3 \approx \alpha_2 + \theta_4$. Thus, it is easy for the user to manipulate the remote controller on the armrest irrespective of the changing position of the backrest 60A.

What is claimed is:

1. A massaging chair comprising:

a frame structure;

a seat attached to said frame structure;

a reclining backrest connected to said frame structure by a seat frame for pivotal movement about a pivot axis between an upright position and a horizontal position with respect to said seat;

a massager disposed on said reclining backrest to give a massage to a back of a user resting on said seat;

said frame structure including said seat frame supporting a seat cushion and a pair of generally U-shaped legs disposed on opposite sides of said seat frame, each said leg having a straight elongated base adapted to engage a floor and a continuously curved portion extending upwardly from said elongated base in offset, substantial overlying relation thereto as a continuously curved cantilevered continuation thereof, said continuously curved portion of said leg extending rearwardly beyond a surface of said backrest adjacent said seat when said backrest is in said horizontal position and defining an armrest having an arm-receiving surface which is convexly curved outward with respect to said backrest pivot axis and extending with respect to said pivot axis at a substantially constant radius in a region of said continuously curved portion of said frame structure to be engaged by an arm of a user, whereby said arm of said user resting on said armrest maintains a substantially constant angle of deflection with respect to said backrest when said backrest is in positions between said upright position and said horizontal position;

each said straight elongated base having stubs extending inwardly therefrom; and at least one of a front foot plate and a rear foot plate supporting said seat frame, each of said foot plates having side ends receiving respective ones of said stubs, thereby connecting said legs to said seat frame.

2. A massaging chair as set forth in claim 1, in which each said leg being provided at an upper portion with a fitting having a catch notch elongated along said upper portion, and an arm cushion supported on said leg upper portion, said arm cushion containing a stud projecting therefrom and being slidably fitted to said upper portion of said leg by engagement with said catch notch.

3. A massaging chair as set forth in claim 2, wherein said arm cushion includes a cover made of a material having a high coefficient of friction.

4. A massaging chair as set forth in claim 2 or 3, further including a control unit for controlling said massager, and wherein each said leg is made of a magnetic material, said control unit being provided with a magnet which is magnetically attached to a desired portion of said leg.

5. A massaging chair as set forth in claim 1, further including lock means for locking said reclining backrest at a desired angle relative to said seat, and a release handle positioned adjacent said pivot axis and being operative to release said lock means to allow said backrest to freely move about said pivot axis.

* * * * *